US008163109B1

(12) United States Patent
Kecskes et al.

(10) Patent No.: US 8,163,109 B1
(45) Date of Patent: Apr. 24, 2012

(54) HIGH-DENSITY HAFNIUM-BASED METALLIC GLASS ALLOYS THAT INCLUDE SIX OR MORE ELEMENTS

(75) Inventors: Laszlo J. Kecskes, Havre de Grace, MD (US); Brian T. Edwards, Charlotte, NC (US); Robert H. Woodman, Holliston, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 346 days.

(21) Appl. No.: 12/569,614

(22) Filed: Sep. 29, 2009

Related U.S. Application Data

(63) Continuation-in-part of application No. 10/828,530, filed on Apr. 6, 2004, now Pat. No. 7,645,350.

(51) Int. Cl.
*C22C 45/00* (2006.01)

(52) U.S. Cl. ..... 148/403; 148/421; 420/423

(58) Field of Classification Search ..... None
See application file for complete search history.

(56) References Cited

U.S. PATENT DOCUMENTS

| | | | | |
|---|---|---|---|---|
| 5,288,344 | A | 2/1994 | Peker et al. | 148/403 |
| 5,618,359 | A | 4/1997 | Lin et al. | 148/561 |
| 5,735,975 | A | 4/1998 | Lin et al. | 148/403 |
| 5,797,443 | A | 8/1998 | Lin et al. | 164/4.1 |
| 5,980,652 | A * | 11/1999 | Inoue et al. | 148/403 |
| 6,562,156 | B2 * | 5/2003 | Liu | 148/561 |
| 6,592,689 | B2 * | 7/2003 | Hays | 148/561 |
| 6,623,566 | B1 | 9/2003 | Senkov | |
| 6,896,750 | B2 * | 5/2005 | Wolter | 148/561 |
| 7,361,239 | B2 | 4/2008 | Zahrah | |
| 7,645,350 | B1 * | 1/2010 | Kecskes et al. | 148/561 |
| 2002/0036034 | A1 | 3/2002 | Xing | |
| 2003/0217790 | A1 | 11/2003 | Wolter | |
| 2006/0081310 | A1 | 4/2006 | Yokoyama | |

OTHER PUBLICATIONS

Gu X., L.Q. Xing, and T.C. Hufnagel, "Glass-Forming Ability and Crystallization of Bulk Metallic Glass $(HE_xZN_x)_{525}Cu_{179}Ni_{146}Al_{10}Ti_5$," J. Non-Cryst. Sol., 311(1):77-82, 2002.

Johnson, W.L., "Bulk Glass-Forming Metallic Alloys: Science and Technology," MRS Bulletin, 24(10):42-56, 1999.

Peker, A., and W.L. Johnson, "A Highly Processable Metallic Glasss: $Zr_{412}Ti_{138}Cu_{125}Ni_{100}Be_{225}$," Appl. Phys. Lett., 63(17):2342-2344, 1993.

Spaepen, F., "A Microscopic Mechanism for Steady State Inhomogeneous Flow in Metallic Glasses," Acta. Met., 25(4):407-415, 1977.

Subhash, G., R.J. Dowding, and L.J. Kecskes, "Characterization of Uniaxial Compressive Response of Bulk Amorphous Zr-Ti-Cu-Bi-Be Alloy," Mat. Sci. and Eng., A334(1):33-40, 2002.

Xing, L.Q., P. Ochin, M. Harmelin, F. Faudot, and J. Bigot, "Alloys of High Glass-Forming Ability," J. Non-Cryst. Sol., 205-207(2):597-601, 1996.

* cited by examiner

*Primary Examiner* — George Wyszomierski
(74) *Attorney, Agent, or Firm* — Christos S. Kyriakou

(57) ABSTRACT

A class of high-density bulk metallic glass hafnium-based alloys, having copper, nickel, aluminum, tin, and titanium or niobium as alloying elements is disclosed. This class includes alloys having higher densities and a higher reduced glass-transition temperature than other known refractory metallic glass alloys.

20 Claims, 6 Drawing Sheets

HIGH-DENSITY HAFNIUM-BASED METALLIC GLASS ALLOYS THAT INCLUDE SIX OR MORE ELEMENTS

CROSS REFERENCE TO RELATED APPLICATIONS

This patent application is a continuation-in-part of and claims priority from U.S. patent application Ser. No. 10/828,530 (ARL 03-60) titled "High-Density Metallic Glass Alloys" filed Apr. 6, 2004, now U.S. Pat. No. 7,645,350. U.S. patent application Ser. No. 10/828,530 is hereby incorporated herein by reference in its entirety.

GOVERNMENT INTEREST

The invention described herein may be manufactured, used, and licensed by or for the United States Government.

BACKGROUND

1. Field of the Invention

The present disclosure relates generally to metallic glass alloys, more particularly to metallic glass alloys that include six or more elements.

2. Related Art

Metallic glass alloys (MGAs), or metallic glasses, are amorphous metals and have been reported as existing in thin ribbon form since as early as the 1950s. Metallic glasses differ from conventional metals in that they lack crystalline structure. The atoms in the amorphous structure are randomly arranged, like in a liquid, rather than sitting on a repeatable, orderly lattice. This lack of crystalline structure means that metallic glasses also lack crystalline defects, such as grain boundaries and dislocations. Without these defects metallic glasses exhibit extraordinary mechanical properties, magnetic behavior, and corrosion resistance.

Because the equilibrium structure for a metal alloy is typically crystalline, amorphous metals can only be produced by rapid cooling from the liquid state. Until recently, the cooling rates required were on the order of $10^5$-$10^6$ K/s, which limit the thickness of a fully amorphous alloy to fractions of a millimeter. The resulting ribbons and wires are used extensively as transformer cores and magnetic sensors, but the small dimensions limit the structural applications of the material.

The recent development of bulk metallic glasses has opened the door for use of these fascinating materials in structural applications. These alloys require cooling rates of only 1-100 K/s, so fully amorphous castings up to a centimeter thick can be manufactured using conventional casting methods. Metallic glass alloys are used in golf clubs, fishing rods, car bumpers, aircraft skins, artificial joints, dies, armor-piercing projectiles, engine parts, and cutting tools.

The recent development of zirconium (Zr)-based MGAs (compositions with much lower critical cooling rates and thus castable in thicker sections) are interesting candidates for structural material applications because of the increased thickness (Johnson, W. L., "Bulk Glass-Forming Metallic Alloys: Science and Technology," *MRS Bulletin,* 24(10):42-56, 1999). Specifically, these MGAs generally possess very high elastic strain limits (2 to 3%) and therefore very high yield strengths (about 1.6 GPa). Beyond their elastic limits, however, MGAs do not strain harden, and plastic deformation is immediately localized into shear bands. Shear bands thus serve as a MGA's sole mechanism of plastic flow, under quasi-static as well as dynamic stress loads. The localization is generally modeled as resulting from a reduction in local viscosity, associated with an increase in "free volume" as atoms move within the amorphous structure, but there is not a universally agreed-upon explanation for this behavior (Spaepen, F., "A Microscopic Mechanism for Steady State Inhomogeneous Flow in Metallic Glasses," *Acta. Met.,* 25(4): 407-415, 1977). At higher strain rates, the additional thermal-softening component leads to an earlier failure along one of the first shear bands, reducing the net accumulation of the plastic deformation (Subhash, G., R. J. Dowding, and L. J. Kecskes, "Characterization of Uniaxial Compressive Response of Bulk Amorphous Zr—Ti—Cu—Ni—Be Alloy," *Mat. Sci. and Eng.*, A334(1):33-40, 2002).

Unfortunately, most Zr-based MGAs have relatively low densities of less than 7 g/cm$^3$. Coupled with typical failure strengths of 1.6 GPa, their use disallows compressive load-bearing applications which require higher densities and higher strengths, and without the customary plastic flow and deformation.

Current quinary hafnium (HO-based MGAs, with higher densities of at least 10.5 g/cm$^3$ still remain relatively poor glass formers. That is, their glass forming ability, measured by $T_{rg}$, the reduced glass transition temperature, defined as the ratio of the glass transition temperature to that of the liquidus temperature, ranges from about 0.58 to 0.62. However, typically, good glass forming MGAs will have $T_{rg}$ values of 0.63 to 0.67.

Therefore, it would be desirable to alter MGA chemistry to improve upon $T_{rg}$.

Thus, there is a need for new metallic glass alloys.

There is still another need for metallic alloys that made from or otherwise include six or more elements.

Yet another need exists for glass metallic alloys having a density greater than 7 g/cm$^3$.

SUMMARY

The present disclosure provides metallic glass alloys (MGA)s which can be generally represented by the formula $X_aCu_bNi_cAl_dY_eZ_f$ wherein X includes at least one transition metal element selected from periodic table Group IV; Y or Z includes at least one element selected from Group IV transition metal elements, wherein X is neither equal to Y, nor equal to Z, Group VA, VIII, IVB, and VB; wherein a+b+c+d+e+f=100% (atomic percent); and a is less than 60, preferably $35<a<45$, $15<b<35$, $5<c<25$, $0.1<d<20$, $0.1<e<15$, and $0.1<f<15$. Exemplary alloys in this composition range can be formed into an amorphous, glassy structure at moderate cooling rates of less than 1,000 K/s. In certain embodiments, glass alloys of the present invention include, but are not limited to six elements. In other embodiments, glass alloys of the present invention consist only of six elements: X, Cu, Ni, Al, Y, and Z. And, in other embodiments, glass alloys of the present invention consist essentially of six elements and may include minor amounts of additional elements or X, Y, or Z can represent a mixture of elements in a specified group. For example, Y may represent a mixture of Group IVA elements including, but not limited to: titanium (Ti), zirconium (Zr), and hafnium (Hf) and/or Group VA elements including, but not limited to: niobium (Nb), vanadium (V), and tantalum (Ta). And, Z may represent a mixture of Group IVB elements including, but not limited to: tin (Sn), germanium (Ge), lead (Pb), silicon (Si), and carbon (C).

In certain particularly desirable embodiments the present invention provides exemplary glass metallic alloys having a density of greater than 7 g/cm$^3$. In certain other desirable embodiments the present invention provides representative alloys which have one or more characteristic features of known metallic glasses including: a distinct glass transition, a supercooled liquid region, and a devitrication sequence which results in the loss of the disordered structure. Moreover, alloys in certain desirable embodiments exhibit failure in a quasi-brittle manner, wherein an elastic stress response is followed by a small plastic deformation region, and subsequent catastrophic failure in a narrow, localized region of the material.

Exemplary alloys of the present invention may be formed into a bulk solid having a disordered atomic structure, i.e., metallic glass, by any one of several techniques such as arc melting, copper mold casting, suction casting, melt spinning, splat quenching, injection die casting, extrusion, or other methods. The metallic glass compositions can be shaped into articles, for example projectiles, bullets, spheres, pellets, sheets, bars, ingots, plates, and so forth.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

PRIOR ART

Figure 1:
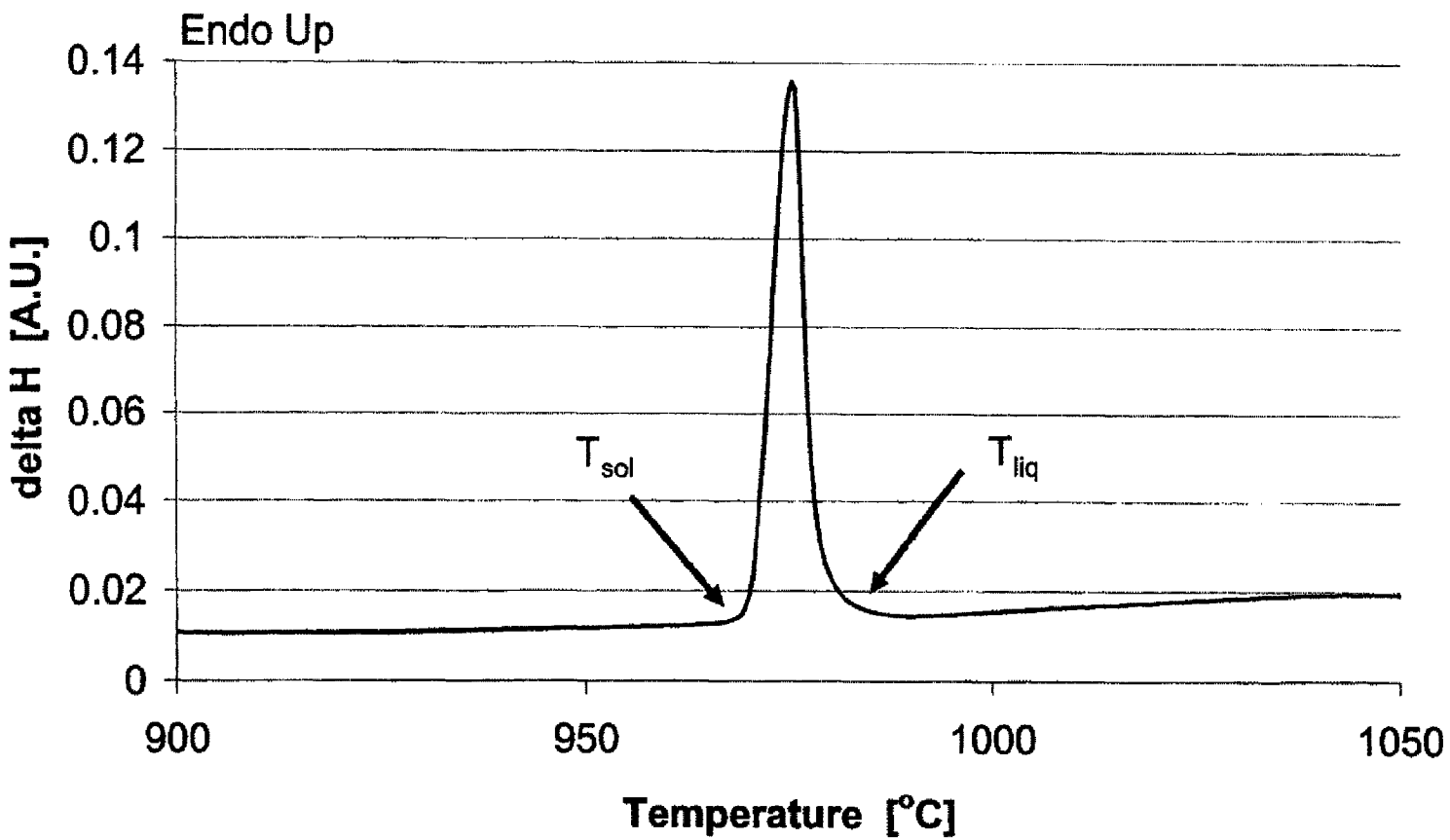
FIG. 1 is a differential thermal analysis trace for exemplary alloy composition 1, showing the solidus and liquidus of the alloy, in accordance with a preferred embodiment of the invention.

Despite the high degree of chemical similarity between Hf and Zr, the direct substitution of Hf for Zr into a Zr-based MGAs results in a significant degradation of the glass-forming ability of the material. Specifically, Gu has shown previously with the behavior of a five-component $Zr_{52.5}Cu_{17.9}Ni_{1.6}Al_{10}Ti_5$ alloy that despite an increase in density, the glass forming monotonically decreases when a sixth element is added (Gu, X., et al., "Glass Forming Ability and Crystallization of Bulk Metallic Glass $(Hf_xZr_{1-x})_{52.5}Cu_{17.9}Ni_{14.6}Al_{10}Ti_5$," *J. Non Cryst. Solids,* 311:77-82, 2002). More importantly, the corresponding thermal response is indicative of significant short-range order changes in the local distribution of the elemental components. As such, in contradiction with Gu's own conclusions, the results demonstrate that direct substitution is counterindicative of the empiral rules used for alloy development. Specifically, it has been discovered that although the Zr-based MGA may be a eutectic or near-eutectic composition, the equivalent Hf-based MGA is not. Typically, a eutectic composition melts congruently, with a sharp endothermic peak in its differential thermal analysis trace. That is, it behaves as a single-phase solid transforming into a liquid at one temperature. In contrast, an off-eutectic composition exhibits a considerably wide endothermic peak. As such, the Zr-based MGA would be expected to have a relatively narrow endotherm. However, with increasing Hf substitution this peak shifts to higher temperatures, broadens and, beyond a certain composition, it bifurcates into multiple peaks. This devitrification behavior is not preferred.

Consequently, it was necessary to determine the precise position of the eutectic or eutectics in the Hf—Cu—Ni ternary system. It has been discovered that the position of this eutectic composition is not the same composition as that found in the Zr—Cu—Ni system.

Specifically, unlike the Zr—Cu—Ni system that has only one known eutectic composition, new evidence shows that the Hf—Cu—Ni ternary system contains at least two or more eutectics. While the existence of eutectics aids the development and discovery of metallic glass alloy compositions, without an a-priori knowledge of the number and the precise location of these eutectics, interpretation of the differential thermal analysis trace can be rather difficult. This is especially apparent for eutectics that are compositionally close to one another.

Independent of the intricacies of alloy development, it is a well accepted fact that, despite of Gu's results, usually an increase of the number of elemental components in an alloy composition improves glass forming ability. Empirical rules of glass design dictate to select component elements that have negative enthalpies of mixing, have dissimilar atomic radii, and produce widely varying crystalline structures upon slow cooling. Thus, the introduction of a new component that further complicates or frustrates the system is highly desired. However, the selection of the new element requires that they are chemically distinct and not from the same family in the periodic table.

While a previously developed five component hafnium-based alloy has fairly good glass forming ability, the addition of other dissimilar elements would likely improve the glass forming ability and thus the dimensions of the largest cast part.

DETAILED DESCRIPTION

Exemplary glass metallic alloys of the present disclosure include six or more elements and can be generally represented by the formula $X_aCu_bNi_cAl_dY_eZ_f$; wherein X comprises one or more elements selected from Group IV transition metal elements, preferably one or more elements selected from Group IVA transition metal elements; wherein Y or Z comprises at least one element selected from Group IV transition metal elements, VA, VIII, IVB, and VB, respectively; wherein a+b+c+d+e+f=100% (atomic percent); and a is less than 60, preferably $35<a<45$, $15<b<35$, $5<c<25$, $0<d<20$, $0<e<15$, and $0<f<15$. Thus, in certain embodiments a glass composition of the present invention may contain or otherwise include: from about 35 to about 45 atomic percent of element X, preferably 35 to about 45 atomic percent of X, more preferably from about 44 to about 45 atomic percent of X and still more preferably about 44.5 atomic percent of X; from about 15 to about 35 percent copper (Cu), preferably from about 25 to about 30 percent Cu, more preferably from about 26 to about 28 percent Cu and still more preferably about 27 atomic percent Cu; from about 5 to about 25 atomic percent nickel (Ni), preferably from about 10 to about 15 atomic percent Ni, more preferably from about 13 to about 14 atomic percent Ni and still more preferably about 13.5 atomic percent Ni; from about 0 to about 20 atomic percent titanium (Ti), preferably from about 0.1 to about 20 atomic percent Ti, more preferably from about 0.1 to about 5 atomic percent Ti, still more preferably from about 2 to about 4 atomic percent Ti and still more preferably about 3 atomic percent Ti; from about 0 to about 15 atomic percent of element Y, preferably from about 0.1 to about 15 atomic percent Y, preferably from about 0.1 to about 5 atomic percent Y, more preferably from about 1 to about 3 atomic percent Y, and still more preferably about 2 atomic percent Y; and from about 0 to about 15 atomic percent of element Z, preferably from about 5 to about 15 atomic percent of Z, preferably from about 8 to about 12 atomic percent of Z and still more preferably about 10 atomic percent of Z. In certain desirable embodiments X is hafnium (Hf). In certain desirable embodiments Y is Ti, niobium (Nb), or a combination thereof. And, in certain desirable embodiments Z is tin (Sn).

Thus in certain embodiments, $35<a<45$, $15<b<35$, $5<c<25$, $0.1<d<20$, $0.1<e<15$, and $0.1<f<15$; more preferably, $40<a<45$, $20<b<30$, $10<c<20$, $0.1<d<10$, $0.1<e<10$, and $5<f<10$; and even more preferably, $44<a<45$, $20<b<30$, $10<c<15$, $0.1<d<5$, $0<e<5$, and $5<f<15$. Suggested Group IVA transition metal elements include, but are not limited to, Ti, Zr, and Hf. Suggested Group VA elements include, but are not limited to: V, Nb, and Ta. Suggested Group VIII elements include, but are not limited to: Fe, Co, Ni, Ru, Rh, Pd, Os, Ir, and Pt. Suggested Group VB elements include, but are not limited to: P, As, Sb, and Bi. And, suggested Group IVB elements include, but are not limited to: C, Si, Ge, Sn, and Pb.

One desirable embodiment, among others, provides glass metallic alloys of the general formula above wherein the alloys have a density of at least 7 g/cm$^3$ while optionally retaining at least one characteristic of known MGAs including but not limited to: a distinct glass transition, a supercooled liquid region, and a devitrication sequence that results in the loss of the disordered structure.

Certain desirable embodiments of the present invention have a density of at least about 7 g/cm$^3$ and advantageously have a reduced glass transition temperature, for example a glass transition which is predicated on a unique combination of its three principal constituents (Hf, Cu, and Ni). This combination was established through experimentation with the Hf—Cu—Ni ternary system. Certain more desirable embodiments of the present invention have a density of at least about 10 g/cm$^3$. Certain desirable embodiments of the present invention have a density of at least about 10.5 g/cm$^3$.

The components of an exemplary MGA can be formed into a master-alloy ingot by inert-gas tungsten-arc melting or by other common metallurgical techniques (e.g., vacuum-induction melting, skull melting, plasma melting, etc.). The master alloy may be formed into a MGA having an amorphous structure by methods including, but not limited to, copper mold casting, arc-melt quenching on a water-cooled copper plate, water or oil quenching, melt spinning, planar flow casting, extrusion, or powder atomization and so forth. The MGA thus formed has no long-range order and exhibits a well-defined glass transition with a supercooled liquid region. The required cooling rate to circumvent or suppress crystal formation for the MGA lies between 1 and 1000 K/s depending on exact composition and purity, which makes the alloy suitable for processing in bulk form.

Some embodiments of the alloys presented have a well defined glass transition temperature that occurs at approximately 788 K (515° C.), and liquefy below 1248 K (975° C.). Hence, in one embodiment the alloys have a reduced glass transition temperature of about (788/1248)=0.631, which serves to indicate that the alloy is fairly easy to cast into the amorphous state. Similar alloys considered to be good MGA formers have reduced glass transitions of 0.55-0.67. The first alloy being presented has a single exothermic crystallization event at about 838 K (565° C.). The difference between the first crystallization event and the glass transition denotes the supercooled liquid region. For this alloy the supercooled liquid region is about 60 K, which is consistent with other MGAs.

EXAMPLE 1

Samples of the desired MGA composition of $Hf_{44.5}Cu_{27}Ni_{13.5}Ti_3Sn_2Al_{10}$ were prepared by arc melting high-purity elemental metals in a purified argon atmosphere, followed by suction casting of the alloy into copper molds. The master alloy composition was prepared by arc melting in an argon atmosphere that was purged of oxygen through a series of evacuations and backfills. All melting was done on a water-cooled oxygen free high conductivity (OFHC) copper plate. The alloy was remelted several times and then suction cast into a copper mold to produce an amorphous rod of three (3) mm diameter and 100-mm length. Density measurements of the ingot material, using Archimedes' Principle, yielded a density of 10.93 g/cm$^3$. Thus, in one exemplary embodiment a glass composition of the present invention includes from about 44 to about 45 atomic percent of hafnium, from about 25 to about 30 percent copper, from about 10 to about 15 atomic percent nickel, from about 3 to about 4 atomic percent titanium, from about 1 to about 3 atomic percent tin and from about 5 to about 15 atomic percent aluminum. The glass composition may contain up to about 12 atomic percent of other elements, preferably metallic elements.

FIG. 1 shows a differential thermal analysis trace of the melting behavior of the alloy. Heating was done at a rate of 5 K/min. The plot shows an onset temperature of 1243 K (970° C.), corresponding to the solidus, and the endpoint temperature of 1253 K (980° C.), corresponding to the liquidus. This was the only melting event present for the alloy.

Figure 2:
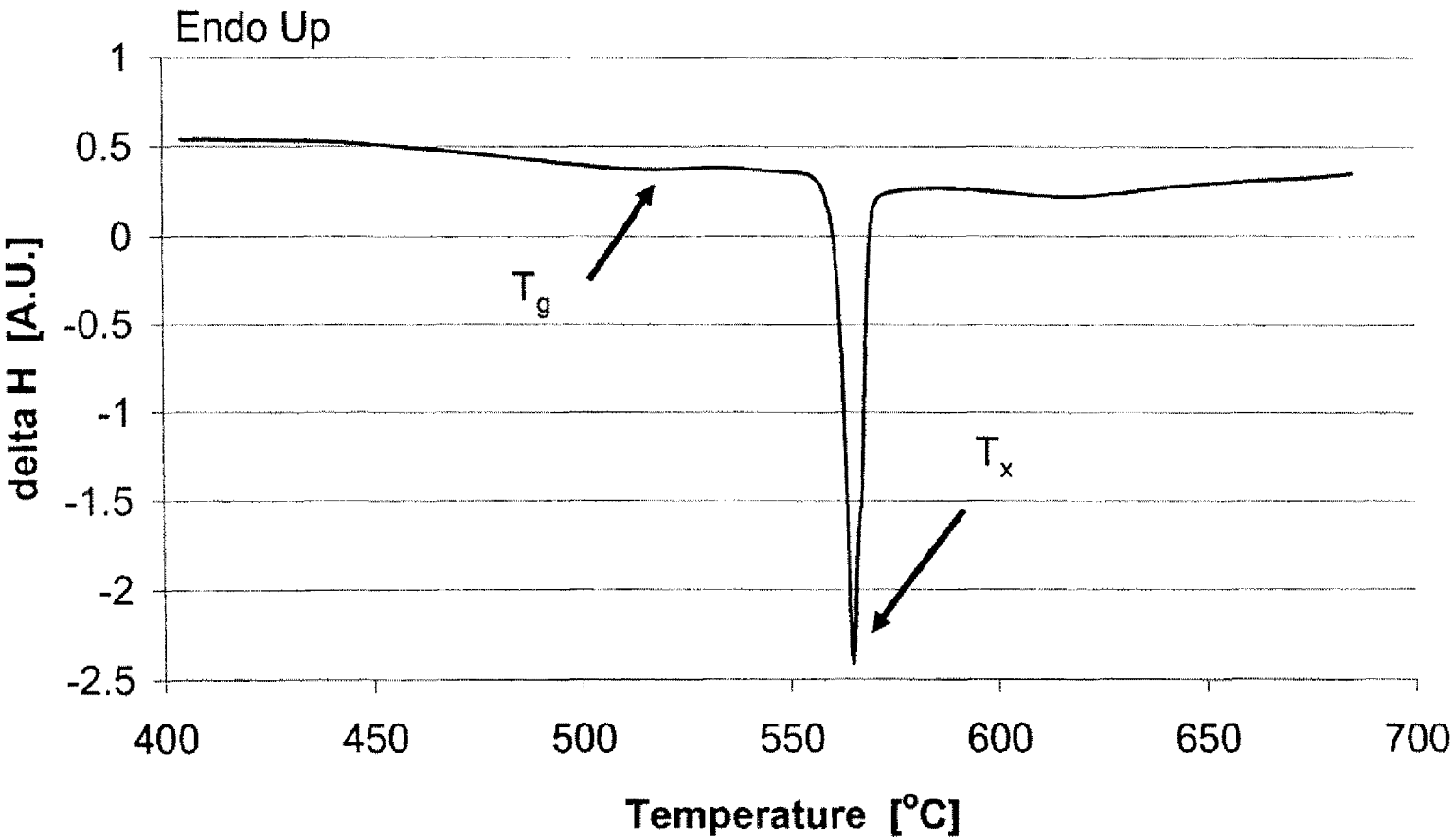
FIG. 2 is a differential thermal analysis trace for exemplary alloy composition 1, showing the glass transition and crystallization temperatures, in accordance with a preferred embodiment of the invention.

FIG. 2 shows a differential thermal analysis trace plot of the glass transition, $T_g$, and crystallization, $T_x$, temperatures of the as-cast MGA sample. The glass transition is at 786 K (513° C.). The onset for crystallization of the glass is at 838 K (565° C.); there is only one crystallization event for this glass. The supercooled liquid region, the difference between glass transition and crystallization temperatures, is 52 K. The reduced glass transition temperature, denoted as the ratio of glass transition to liquidus temperature (i.e., the high-temperature endpoint of the congruent melting event shown in FIG. 1) is approximately 0.627.

Figure 3:
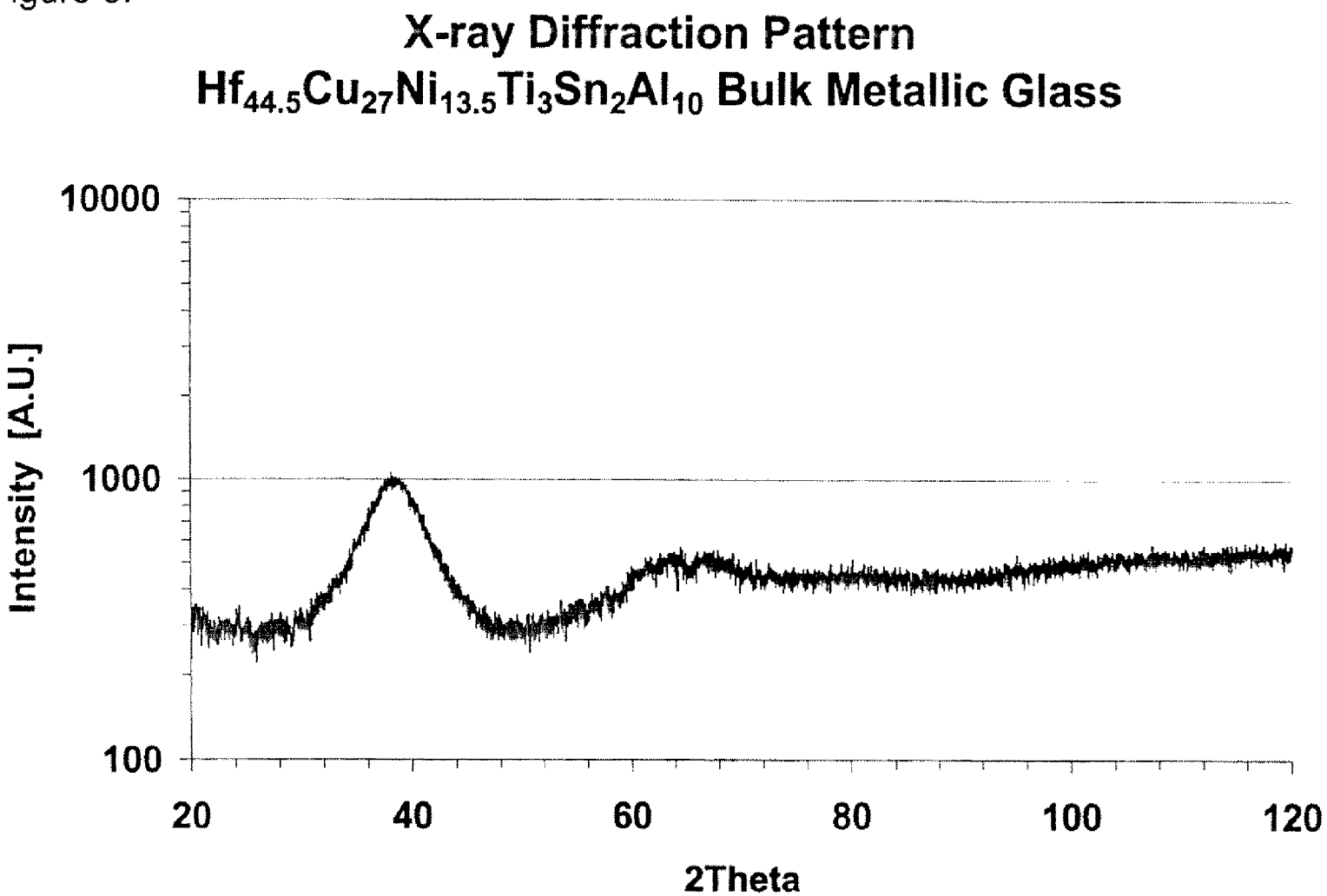
FIG. 3 is a plot of X-ray intensity versus diffraction angle for exemplary alloy composition 1.

FIG. 3 shows a plot of the X-ray diffraction scan of the as-cast sample. The plot shows only two broad, diffuse intensity peaks corresponding to the lack of crystalline order in the material. More importantly, there are no sharp Bragg peaks indicative of crystalline phases, which is further evidence that the sample is in fact amorphous.

Metallic glass alloys of the present invention may be formed into a bulk solid by any one of several techniques including, but not limited to, arc melting, copper mold casting, suction casting, melt spinning, splat quenching, injection die casting, extrusion, or other methods and can be shaped into any of a variety of articles including, but not limited to bullets, spheres, pellets, sheets, bars, ingots, or plates.

It should be emphasized that the above-described embodiments of the present invention, particularly, any "preferred"

embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

EXAMPLE 2

Samples of the desired MGA composition of $Hf_{44.5}Cu_{27}Ni_{13.5}Nb_3Sn_2Al_{10}$ were prepared by arc melting high-purity elemental metals in a purified argon atmosphere, followed by suction casting of the alloy into copper molds. The master alloy composition was prepared by arc melting in an argon atmosphere that was purged of oxygen through a series of evacuations and backfills. All melting was done on a water-cooled OFHC copper plate. The alloy was remelted several times and then suction cast into a copper mold to produce an amorphous rod of three (3) mm diameter and 100-mm length. Density measurements of the ingot material, using Archimedes' Principle, yielded a density of 10.97 g/cm$^3$.

Figure 4:
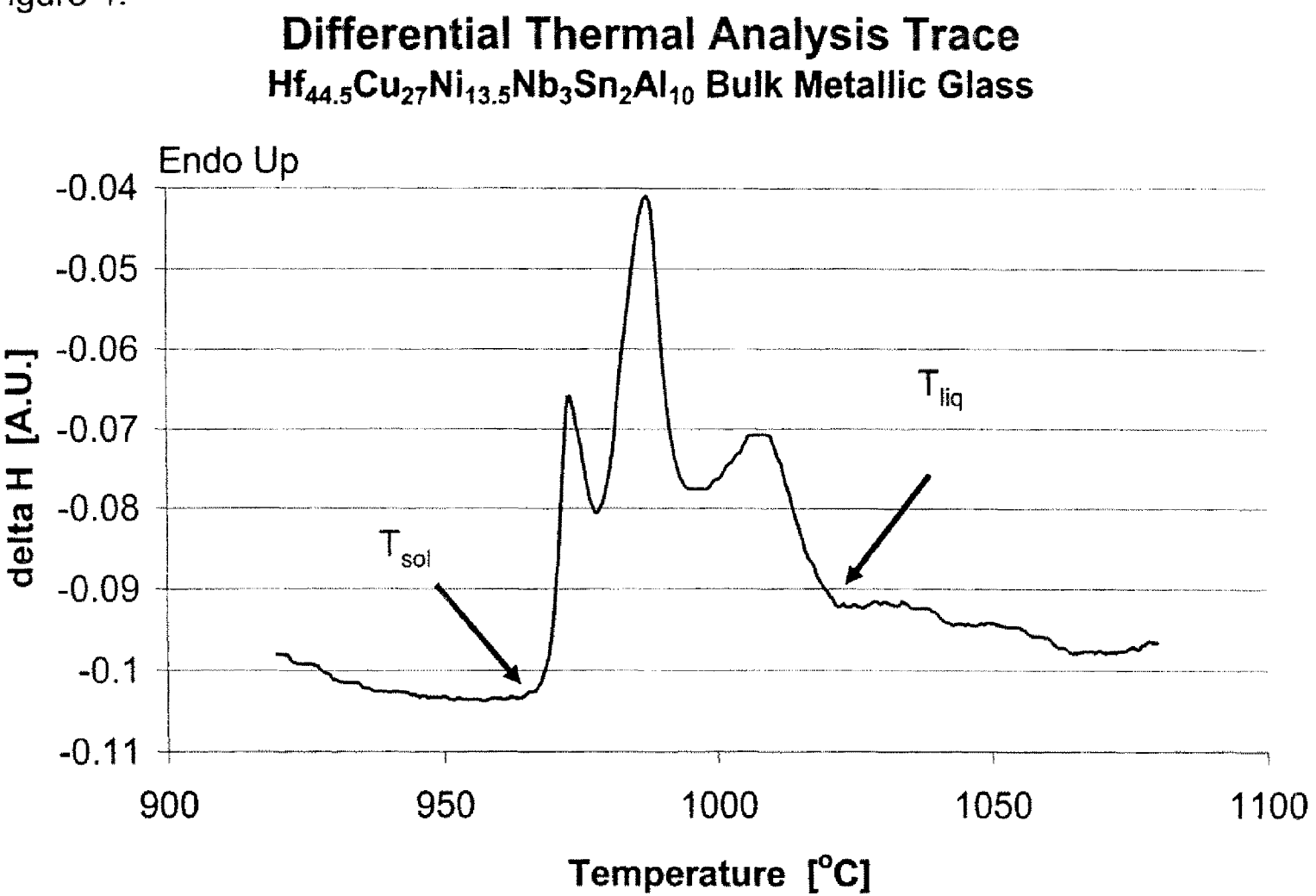
FIG. 4 is the differential thermal analysis trace for exemplary alloy composition 2, showing the solidus and liquidus of the alloy, in accordance with a preferred embodiment of the invention.

FIG. 4 shows a differential thermal analysis trace of the melting behavior of the alloy. Heating was done at a rate of 5 K/min. The plot shows an onset temperature of 1239 K (966° C.), corresponding to the solidus, and the endpoint temperature of 1296 K (1023° C.), corresponding to the liquidus. This was the only melting event present for the alloy. Note that the melting behavior of this glass is highly dissimilar from that shown in Example 1. The glass melts incongruently, exhibiting a complex melting phenomenon.

Figure 5:
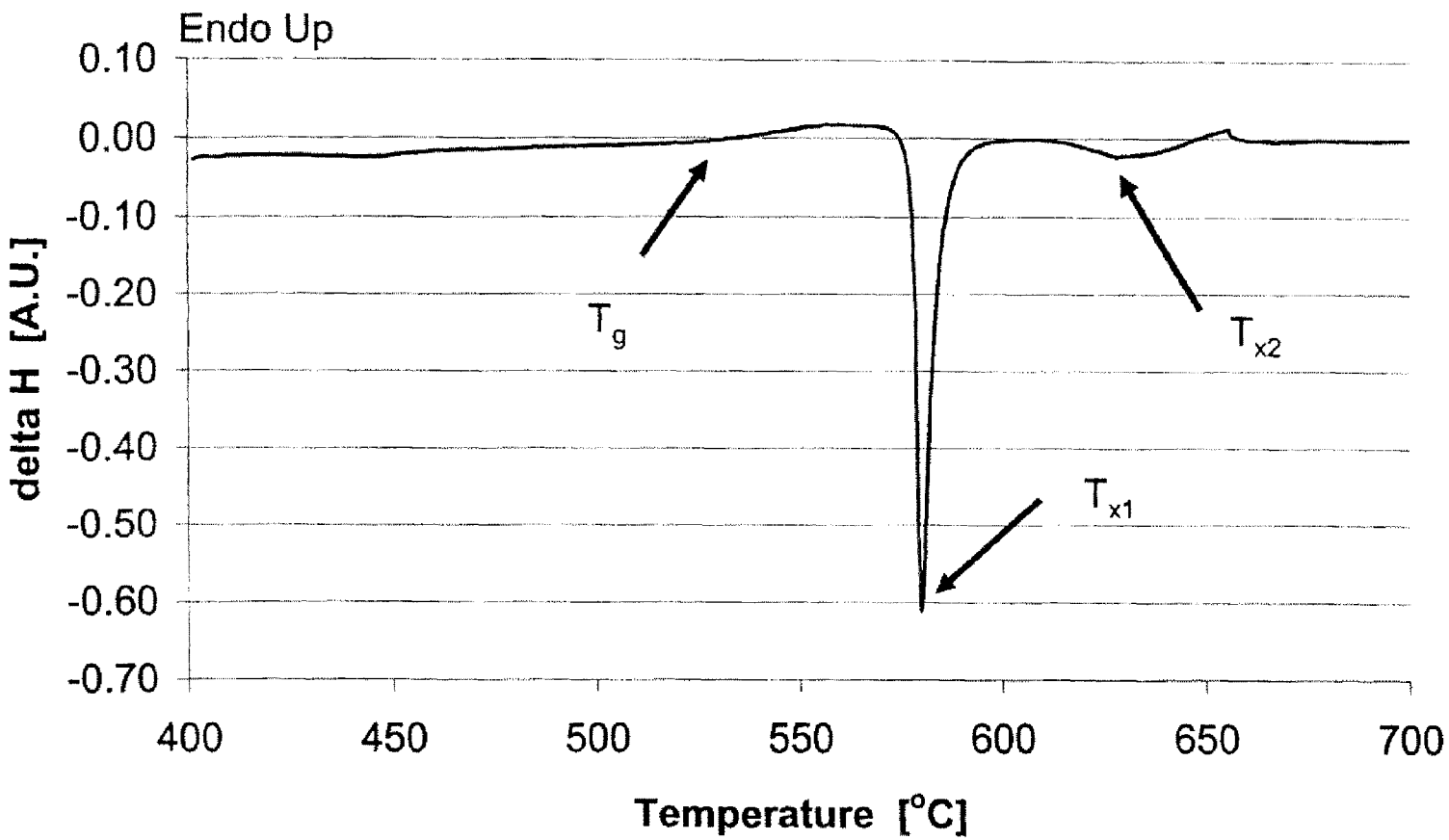
FIG. 5 is the differential thermal analysis trace for exemplary alloy composition 2, showing the glass transition and crystallization temperatures, in accordance with a preferred embodiment of the invention.

FIG. 5 shows a differential thermal analysis trace plot of the glass transition, $T_g$, and crystallization, $T_{x1}$, $T_{x2}$, temperatures of the as-cast MGA sample. The glass transition is at 794 K (521° C.). The peak temperature for the first crystallization of the glass is at 853 K (580° C.). The peak temperature for the second crystallization of this glass is at 905 K (632° C.); there are only two crystallization events for this glass. The supercooled liquid region, the difference between glass transition and crystallization temperatures, is 59 K. The reduced glass transition temperature, denoted as the ratio of glass transition to liquidus (i.e., the high-temperature endpoint of the complex melting event shown in FIG. 5) is approximately 0.613.

Figure 6:
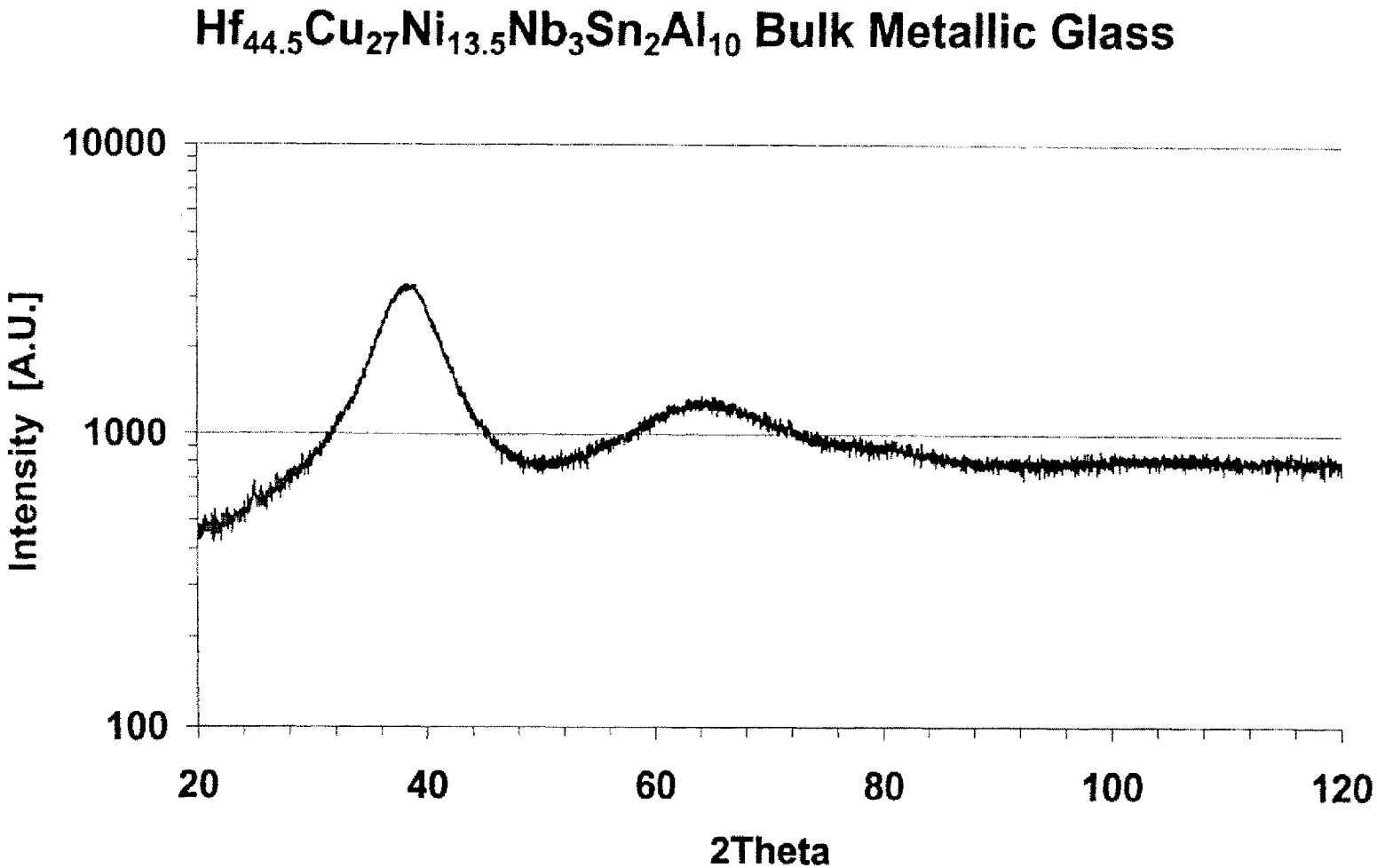
FIG. 6 is a plot of X-ray intensity versus diffraction angle for exemplary alloy composition 2.

FIG. 6 shows a plot of the X-ray diffraction scan of the as-cast sample. The plot shows only two broad, diffuse intensity peaks corresponding to the lack of crystalline order in the material. More importantly, there are no sharp Bragg peaks indicative of crystalline phases, which is further evidence that the sample is in fact amorphous.

Metallic glass alloys of the present invention may be formed into a bulk solid by any one of several techniques including, but not limited to, arc melting, copper mold casting, suction casting, melt spinning, splat quenching, injection die casting, extrusion, or other methods and can be shaped into any of a variety of articles including, but not limited to bullets, spheres, pellets, sheets, bars, ingots, and plates.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

We claim:

1. A metallic glass alloy of the formula $X_aCu_bNi_cAl_dY_eSn_f$ wherein

X comprises at least one element from Group IVA;

Y comprises at least one element from Group IVA, IVB, VA, VB or VIII, wherein X is not equal to Y, and neither X nor Y is Sn;

a is less than about 60 atomic percent;

b is from about 15 to about 35 atomic percent;

c is from about 5 to about 25 atomic percent;

d is from about 0.1 to about 20 atomic percent;

e is from about 0.1 to about 15 atomic percent; and f is from about 0.1 to about 15 atomic percent, wherein a+b+c+d+e+f=100.

2. The metallic glass alloy of claim 1, wherein a is about 45 atomic percent or less.

3. The metallic glass alloy of claim 1, wherein X is Hf or Zr and Y is Ti or Nb.

4. The metallic glass alloy of claim 1, further comprising a density greater than about 7 g/cm$^3$.

5. The metallic glass alloy of claim 4, having about 3 or more atomic percent Ti.

6. The metallic glass alloy of claim 4, having about 3 or more atomic percent Nb.

7. The metallic glass alloy of claim 4, having about 2 or more atomic percent Sn.

8. The metallic glass alloy of claim 1, wherein the density is about 10.5 g/cm$^3$ or more.

9. The metallic glass alloy of claim 1, wherein the alloy exhibits a distinct glass transition temperature, which is greater than at least 0.60 of the liquidus temperature of the alloy.

10. The metallic glass alloy of claim 1, wherein the ratio of copper to nickel is about 2:1.

11. The metallic glass alloy of claim 1, wherein d is greater than about 10 atomic percent.

12. The metallic glass alloy of claim 1, wherein $35<a<60$, $15<b<35$, $5<c<25$, $0.1<d<20$, $0.1<e<15$, and $0.1<f<15$.

13. An article comprising the metallic glass alloy of claim 1.

14. A metallic glass alloy composition consisting essentially of:

about 44.5 atomic percent Hf;

about 27 atomic percent Cu;

about 13.5 atomic percent Ni;

about 10 atomic percent Al;

about 2 atomic percent Sn; and about 3 atomic percent Ti or Nb.

15. The composition of claim 14 having a density greater than about 7 g/cm$^3$.

16. The composition of claim 14, having a density of about 10.9 g/cm$^3$ or more.

17. The composition of claim 14, wherein the composition exhibits a distinct glass transition temperature of at least 0.62 of the liquidus temperature of the composition.

18. The article of claim 14, wherein the metallic glass is at least partially crystalline.

19. A metallic glass alloy comprising Hf, Cu, Ni, Al, and Sn in a eutectic combination with Ti or Nb or a combination thereof, having a density greater than about 7 g/cm$^3$.

20. A metallic glass alloy of the formula $Hf_aCu_bNi_cAl_dY_e$-$Sn_f$ wherein Y is Ti or Nb or a mixture thereof;

a is less than about 60 atomic percent;

b is from about 15 to about 35 atomic percent;

c is from about 5 to about 25 atomic percent;

d is from about 0.1 to about 20 atomic percent;

e is from about 0.1 to about 15 atomic percent; and f is from about 0.1 to about 15 atomic percent, wherein a+b+c+d+e+f=100.

* * * * *